US007472640B2

(12) United States Patent
Maffeis

(10) Patent No.: US 7,472,640 B2
(45) Date of Patent: Jan. 6, 2009

(54) PNEUMATIC ROTARY ACTUATOR

(75) Inventor: Giuseppe Maffeis, Roncadelle (IT)

(73) Assignee: Gimatic S.p.A, Brescia (IT)

( * ) Notice: Subject to any disclaimer, the term of this patent is extended or adjusted under 35 U.S.C. 154(b) by 0 days.

(21) Appl. No.: 11/678,260

(22) Filed: Feb. 23, 2007

(65) Prior Publication Data

US 2007/0204707 A1 Sep. 6, 2007

(51) Int. Cl.
*F01B 9/00* (2006.01)

(52) U.S. Cl. ..... 92/136; 74/422

(58) Field of Classification Search ..... 92/136; 74/422

See application file for complete search history.

(56) References Cited

U.S. PATENT DOCUMENTS 860,536 A * 7/1907 Ellingham ..... 74/465
4,879,920 A * 11/1989 Kerkhoff ..... 74/422
5,560,282 A * 10/1996 Trenner et al. ..... 92/136
2004/0123733 A1* 7/2004 Yamamoto ..... 92/136

* cited by examiner

*Primary Examiner*—F. Daniel Lopez
(74) *Attorney, Agent, or Firm*—McGlew & Tuttle, P.C.

(57) ABSTRACT

A pneumatic control rotary actuator that incorporates a control piston of a rack toothing engaging with a pinion to cause it to rotate together with an item holder device; the pinion has toothing made up of several parallel pins (23) spaced at an angle, positioned and held orderly between a base flange (21) and an item holder disk head (22); the base flange and the disk are each produced by compression molding, die-casting, sinterization and the like, using a low mechanical resistance material whereas the pins are made of some other material with high mechanical properties and hardness.

8 Claims, 2 Drawing Sheets

PNEUMATIC ROTARY ACTUATOR

CROSS REFERENCE TO RELATED APPLICATIONS

This application claims the benefit of priority under 35 U.S.C. § 119 of Italian patent application BS 2006 A 000041 filed Feb. 28, 2006, the entire contents of which are incorporated herein by reference.

FIELD OF THE INVENTION

The present invention pertains to a pneumatically controlled rotary actuator for moving and orienting parts or components in mechanical operations, assembling and the like.

BACKGROUND OF THE INVENTION

The type of pneumatically controlled rotary actuator taken into consideration comprises substantially a body forming a first chamber and a second chamber with planes at right angles, with the first chamber practically tangent to the second chamber, where a pneumatic piston subject to alternating movements is housed, and in the second chamber is also housed and supported a rotating cogged pinion with an item holder device, and where the piston has a rack cogged attachment designed to engage with the pinion to turn the latter together with the item holder device in response to the alternating movements of the piston.

According to the known technique, the cogged pinion for such an actuator is made out of a single piece through mechanical machining and precision cogs on machine tools.

Evidently, this machining procedure of the pinion necessitates considerable time and is costly, which are further increased if you consider that in order to ensure the required resistance under force and the wear on its cogs, the pinion must be made out of a material with very high mechanical properties and hardness, therefore in itself relatively precious and costly. More often also, the item holder device is an integral part of the pinion therefore it also has to be made of the same material as the pinion and machined at the same time.

According to the state of the technique, the construction of a pinion structure with, instead of the traditional radial cogs, has pins positioned and held between two head flanges and spaced at angles around a rotation axis, is also known, in that it was proposed by the same applicant. However, on the one hand, also in this case the flanges were made by machining items made of a high strength material such as steel, the same being valid for the pins but, on the other hand, such a pinion structure has never been used in rotary actuators.

SUMMARY OF THE INVENTION

Starting from the above premises, one objective of the invention is to create the conditions so that a pneumatic rotary actuator of the type mentioned above can be made in a simpler and more economic way, at least by minimizing times and costs of making and assembling some of its components, but nonetheless ensuring a high quality and reliable product.

Another objective of the invention is to propose a pinion which can be produced using simplified molding techniques, without however having to turn to mechanical machining on machine tools or at least significantly liming their use.

The task of the invention in fact, is to supply a pneumatically operated rotary actuator and incorporating, therefore, a rotating pinion with "toothing" made up of several parallel pins, spaced at an angle, positioned and held between a base flange and an item holder disk head and where, however, the flange and cover or table are made of low strength and economic low-cost materials whereas the pins are made out of a hard high strength material.

Therefore and advantageously, on the one hand the base flange and the pinion head can be made using molding techniques, such as compression molding, die-casting, sinterization and the like, using initial low-cost materials such as zama (Zn+AL+Mg alloy) whereas the pins can be made out of a material with very high mechanical performance such as steel.

The abovementioned molding techniques can be used to produce finished articles even with relatively complicated shapes, with minimum tolerances, with a high degree of precision, and with the possibility of using surface treatment, where required, so that the base flange and pinion head do not require further intervention and mechanical machining. In other words, the base flange and cover or head can be relatively easily produced at a limited cost, but they cannot be integrated with traditional cog connections made of the same material, in that they would not, in this case, have sufficiently reliable strength for use under force. Whereas, although made of a low-cost material with low mechanical properties, they are part of the assembly of the pins which, being made of a material with high mechanical properties, guarantee the required mechanical strength and wear resistance in coupling with a complementary means, such as the rack of the control piston in the range of a rotary actuator.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiment of the invention are illustrated.

DESCRIPTION OF THE PREFERRED EMBODIMENT

Figure 1:
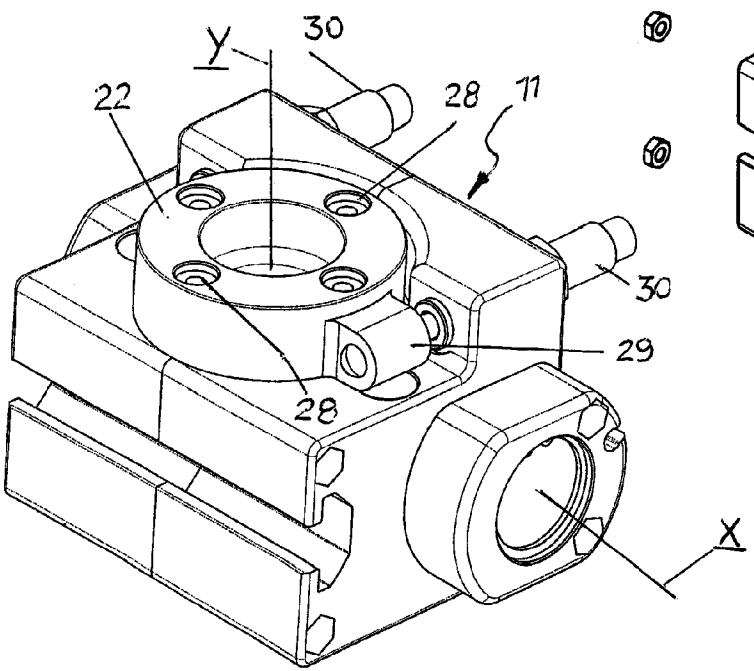
FIG. 1 is a perspective view of the assembled rotary actuator.
Figure 3:
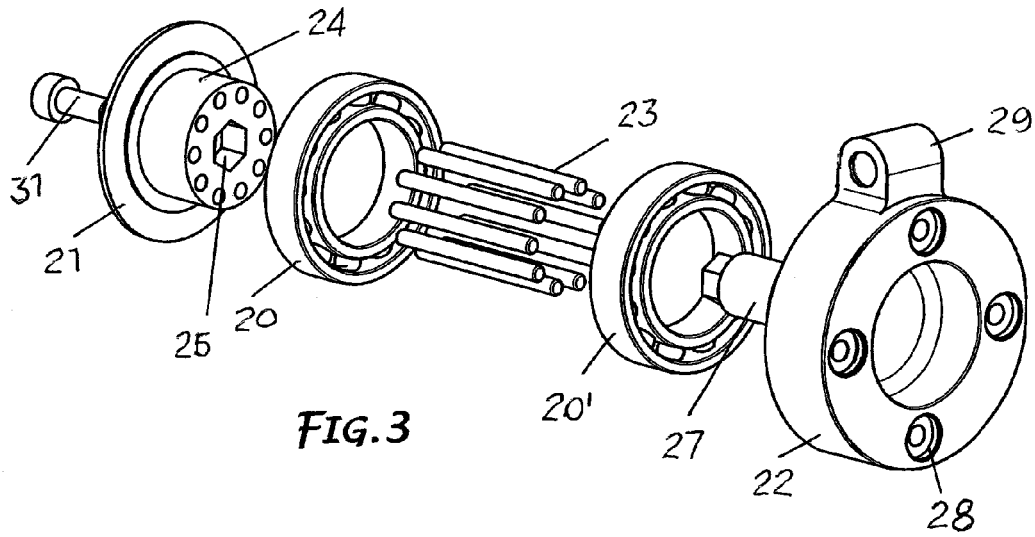
FIG. 3 is an exploded view of the pinion components from one direction.
Figure 4:
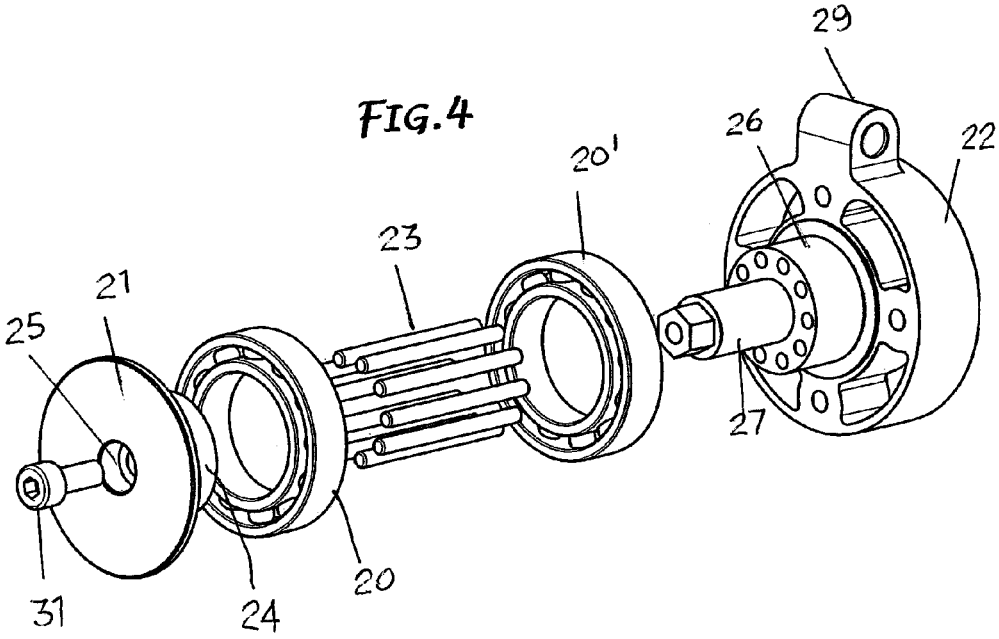
FIG. 4 is an exploded view of the pinion components from another direction.

Referring to the drawings in particular, FIG. 1 shows the rotary actuator under examination basically comprising a body 11, a control piston 12 and a pinion 13.

Figure 2:
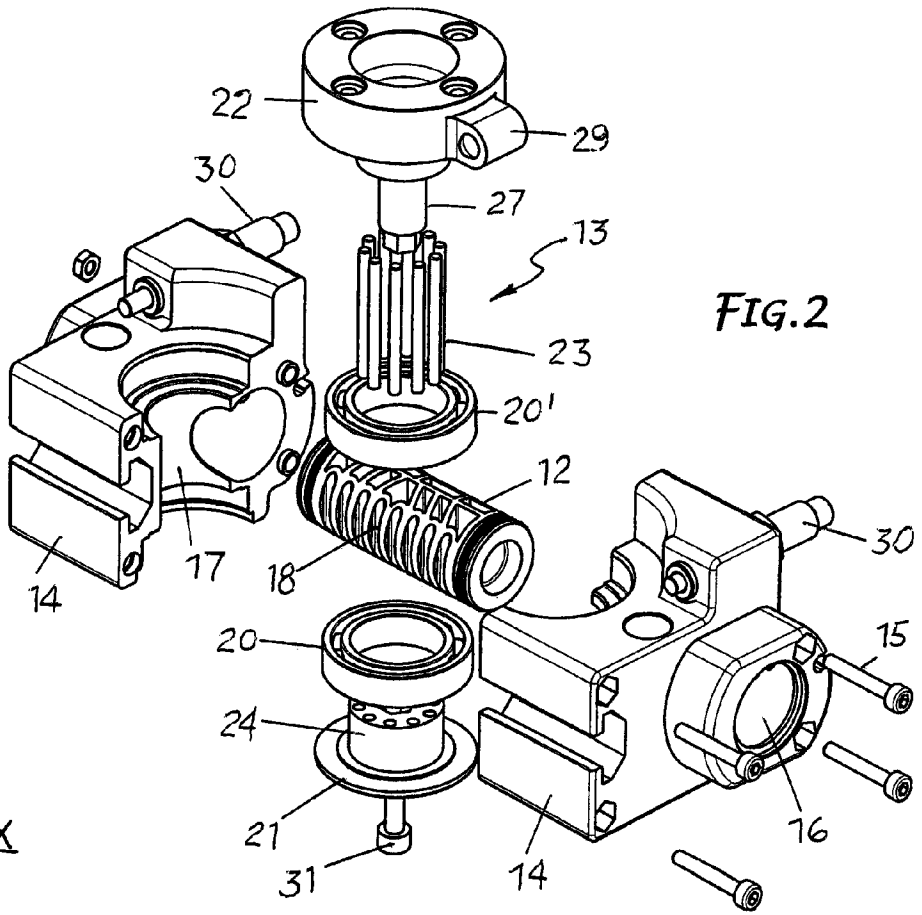
FIG. 2 shows an exploded view of the components of the rotary actuator.

The body 11 can be made out of a single piece or, better, as shown in FIG. 2, out of two complementary opposed elements 14, coupled and fixed together by screws 14,15. In any case, the body 11, whether single or made up of two elements, forms a first chamber 16 which extends according to an X axis and a second chamber 17 with a Y axis at a right angle to the X axis of the first chamber, the latter being basically tangent and crossing the second chamber 17.

The piston 12 has, on one side, a rack 18, it is housed in a first chamber 16 and moves by reciprocating motion, driven by a fluid, usually compressed air, delivered to the first chamber alternatively from opposite sides of the piston.

The pinion 13 is housed and rotates in the second chamber 17 with the interposition of support bearings 20, 20' and it engages with the rack of the piston 12.

The pinion 13 comprises a base flange 21, an item holder disk head 22 and a number of pins 23, that extend between the base flange and the cover or table disk and which acts as toothing for the pinion to engage with the rack attachment of the piston.

The base flange and the cover or disk are produced by compression molding, die-casting, sinterization and the like, using low-cost materials such as zama (Zn+AL+Mg alloy) which are economic and with low mechanical properties. In particular, the base flange 21 is integral with a neck 24 designed to receive a first support bearing 20 and provided with a central bore 25.

The disk head 22 also has a neck 26 designed to receive a second support bearing 20' and an axial shank 27 designed to fit into the central bore 25 of the base flange 21. On the front face of both the neck 24 of the base flange, and the neck 26 of the disk head 22 are provided bores positioned according to the circumference, in which the ends of the pins 23 acting as toothing on the pinion are housed and held.

Furthermore it should be noted that the disk head 22 can also be provided with bores 28 so as to be able to attach at least an item holder device—not shown—and an integral radial wing 29 works with end of stroke elements 30 associated with the body to be carried out.

Prior to assembling each bearing on respective neck, the components 21, 22, 23 of the pinion 13 are coupled and assembled in the direction of the axis and then fixed to each other by a screw 31 designed to block the end of the axial shank 27 of the disk head 22 in the central bore 25 of the base flange 21. Once assembled, the pinion is mounted in its housing 17 formed by the body of the actuator 11, matching the pins 23 with the rack 18 of the piston so that the disk head 22 projects over the body with the possibility of turning depending on the stroke of the piston and angle set by the end of stroke element 30.

While a specific embodiment of the invention have been shown and described in detail to illustrate the application of the principles of the invention, it will be understood that the invention may be embodied otherwise without departing from such principles.

The invention claimed is:

1. A pneumatically controlled rotary actuator comprising:

an actuator body forming a first chamber and a second chamber with orthogonal planes, said first chamber being tangent to said second chamber;

a pneumatic piston subject to alternating movements, said piston being located in said actuator body;

a turning pinion having a base flange and an item holder disk head, said second chamber receiving said turning pinion such that said turning pinion is supported and housed in said second chamber, said piston having a toothed rack engaging with the pinion such that said pinion rotates with the item holder disk head in response to the alternating movements of the piston, wherein said pinion has a toothing formed of parallel pins, said parallel pins extending between said base flange and said item holder disk head, said flange and said item holder disk head being composed of a first material, said pins being composed of a second material, said second material having a mechanical strength that is greater than a mechanical strength of said first material, said base flange having an axial through bore and an integral neck for receiving a first support bearing, said item holder disk head having an axial shank and a neck for receiving a second support bearing, said axial through bore of the base flange receiving one end of said axial shank, said neck of said base flange having a base flange neck side, said neck of said item holder disk head having an item holder disk head neck side, said base flange neck side being disposed opposite said item holder disk head neck side, said base flange neck side and said item holder disk head neck side having bores following a circumference for receiving and holding the ends of said pins forming the toothing of the pinion.

2. Pneumatic rotary actuator according to claim 1, wherein said base flange, said pins and said item holder disk head forming the pinion are coupled and fixed longitudinally.

3. Pneumatic rotary actuator according to claim 2, wherein said central bore of said base flange receives a screw such that said base flange, said pins and said item holder disk head are fixed longitudinally with said screw, said screw being connected to an end of the axial shrank of the disk head.

4. A pneumatic rotary actuator according to claim 1, wherein said base flange and said item holder disk head of the pinion are composed of zama (Zn+AL+Mg alloy) or another low mechanical resistance material, said base flange and said item holder being produced using compression molding, die-casting, or sinterisation, said pins being composed of steel or another material with a mechanical strength greater than said mechanical strength of said first material.

5. A pneumatic rotary actuator according to claim 1, wherein disk head has an integral lateral wing, said disk head having bores for attaching complementary elements, said bores being provided directly during a molding process.

6. A pneumatic rotary actuator according to claim 1, wherein said pinion made up of the pins positioned and held between the base flange and item holder disk head is inserted as a whole with support bearings said second chamber of the actuator body such that said pins engage with the toothing of the pneumatic piston and said disk head protrudes from said body.

7. A pneumatic rotary actuator according to claim 1, wherein said actuator body is either in one piece or made up of two elements which are complementary and assembled to form said first chamber for the piston and said second chamber for the pinion.

8. A pneumatically controlled rotary actuator comprising:

an actuator body forming a first chamber and a second chamber with orthogonal planes, said first chamber being tangent to said second chamber;

a pneumatic piston subject to alternating movements, said piston being located in said actuator body;

a turning pinion having a base flange and an item holder disk head, said base flange having a central bore, said item holder disk head having an axial shank, said second chamber receiving said turning pinion such that said turning pinion is supported and housed in said second chamber, said piston having a toothed rack engaging with the pinion such that said pinion rotates with the item holder disk head in response to the alternating movements of the piston, wherein said pinion has a toothing formed of parallel pins, said parallel pins extending between said base flange and said item holder disk head, said flange and said item holder disk head being composed of a first material, said pins being composed of a second material, said second material having a mechanical strength that is greater than a mechanical strength of said first material, said base flange, said pins and said item holder disk head being coupled and fixed longitudinally via a screw, said central bore of said base flange receiving said screw such that said base flange, said pins and said item holder disk head are coupled and fixed longitudinally with said screw, said screw being connected to an end of the axial shrank of the disk head.

* * * * *